United States Patent [19]

Yamaguchi et al.

[11] Patent Number: 4,935,076

[45] Date of Patent: Jun. 19, 1990

[54] COPPER ALLOY FOR USE AS MATERIAL OF HEAT EXCHANGER

[75] Inventors: Hiroshi Yamaguchi, Higashi-Murayama; Koji Noda, Ageo; Shuichi Yamasaki, Omiya, all of Japan

[73] Assignee: Mitsui Mining & Smelting Co., Ltd., Tokyo, Japan

[21] Appl. No.: 347,481

[22] Filed: May 4, 1989

[30] Foreign Application Priority Data

May 11, 1988 [JP] Japan ..... 63-113760
Sep. 13, 1988 [JP] Japan ..... 63-229465

[51] Int. Cl.[5] ..... C22C 9/02

[52] U.S. Cl. ..... 148/433; 148/434; 420/472; 420/476; 420/477

[58] Field of Search ..... 420/472, 476, 477; 148/412, 413, 433, 434; 165/905

[56] References Cited

U.S. PATENT DOCUMENTS

| | | | |
|---|---|---|---|
| 3,956,027 | 5/1976 | Parikh et al. | 148/11.5 R |
| 4,025,367 | 5/1977 | Parikh et al. | 148/11.5 C |
| 4,047,978 | 9/1977 | Parikh et al. | 148/11.5 C |
| 4,110,132 | 8/1978 | Parikh et al. | 148/11.5 C |
| 4,741,394 | 5/1988 | Tanigawa et al. | 165/43 |

FOREIGN PATENT DOCUMENTS

| | | | |
|---|---|---|---|
| De. 3311960 | 2/1987 | Fed. Rep. of Germany . | |
| 145956 | 9/1982 | Japan | 420/476 |
| 126742 | 7/1984 | Japan | 420/476 |
| 60-194033 | 10/1985 | Japan . | |

OTHER PUBLICATIONS

Standards Handbook, Copper Development Association Inc., 1985, title page, Table of Contents and pp. 8, 98, 99 and 104.

*Primary Examiner*—Richard O. Dean
*Assistant Examiner*—George Wyszomierski
*Attorney, Agent, or Firm*—Flynn, Thiel, Boutell & Tanis

[57] ABSTRACT

A copper alloy suitable for use as the material of a heat exchanger contains 1 to 4.5 wt % of Zn, 1.0 to 2.5 wt %, preferably 1.5 to 2.0 wt % of Sn, 0.005 to 0.05 wt %, preferably 0.01 to 0.04% of P, and the balance substantially Cu and inevitable impurities, and has grain size not greater than 0.015 mm, preferably below 0.01 mm. The alloy exhibits high resistance levels to corrosion such as stress corrosion cracking, dezincification corrosion and so forth, as well as superior workability, strength and solder wettability, and, hence, can suitably be used as the materials of the constituents of a heat exchanger such as tanks, tube plates and tubes.

4 Claims, No Drawings

COPPER ALLOY FOR USE AS MATERIAL OF HEAT EXCHANGER

BACKGROUND OF THE INVENTION (a) Field of the Invention

The present invention relates to a copper alloy suitable for use as a material of a heat exchanger such as a radiator which cools cooling water circulated through an automotive engine, automotive air heater, and various other industrial and household heat exchangers. More particularly, the present invention relates to a copper alloy suitable for use as the material of constituents of a heat exchanger such as the tube plates, tanks and tubes.

(b) Description of the Prior Art

A heat exchanger is composed of tanks, tube plates, tubes and fins. Fins are usually made of a heat-resistant copper having a high purity approximating that of pure copper, whereas the tanks, tube plates and tubes are made of a material such as Cartridge Brass 70% (C2600) or Yellow Brass 65% (C2800), in order to cope with demands for workability, strength and economy.

In general, a copper alloy to be used as the material of the heat exchanger is required to meet the following requirements.

As a heat exchanger in which a coolant, wherein generally polyethers are added to water, is circulated, the constituents of the heat exchanger must have a high corrosion resistance so as to prevent internal corrosion by such a coolant.

It is also preferred that the constituents of a heat exchanger have sufficiently high resistance to resist any external corrosive condition such as a salt-containing atmosphere.

High workability is required for the material of the tanks and the tube plates because they have to be made by deep drawing. In general, the material of such parts is evaluated in terms of the Erichsen value in the Erichsen deep drawing cup test. The material of the tubes also is required to have a high workability approximating that of brass because the tubes are often formed through a complicated rock seam tube process.

The materials of these structural parts also are required to have high mechanical strength which well compares with that of brass. High strength is required particularly when the tank and the radiator core are fixed to each other mechanically, because the required reliability of the mechanical connection may not be obtained when the strength of the material is low. Furthermore, tubes are required to have high rigidity because inferior rigidity will make the work for forming the tubes difficult.

Superior solder wettability is also an important requisite because a heat exchanger, in particular a radiator, employs many portions connected by soldering.

In general, brass exhibits a rather inferior resistance to stress corrosion cracking which often results in a leakage of an internal fluid. Usually, therefore, an annealing is effected to remove any residual stress, thereby preventing occurrence of stress corrosion cracking. Unfortunately, however, annealing alone cannot completely eliminate stress corrosion cracking.

On the other hand, there is a current trend for use of reinforced plastics as materials of constituents of a heat exchanger, particularly as the material of the tank. When such a resinous tank is used, the peripheral Portion of the tube plate is bent to form a concave groove opening to the outside, an elastic seal member is provided in said concave groove to insert the flange portion of the resinous tank, and the upper portion of the outer side of the concave groove is bent inwards to securely attach the tank. In such a case, it is not permissible to effect annealing after the assembly because of the use of the plastic as the tank shell material. In consequence, a considerably high level of residual stress remains in the tube plate, presenting a high sensitivity to stress corrosion cracking. In order to obviate this problem, it is a common practice to use a separately prepared member made of a stainless steel, which is bent and securely attach the tank to the tube plate. This solution, however, is disadvantageous from the view point of economy.

Under these circumstances, discussion is made in the specification of U.S. Pat. No. 4,741,394 as to the use of an alloy containing 15 to 38 Wt % of Zn and 0.05 to 1.5 wt % of Si. Unfortunately, however, there still is a practical limit in the effect of prevention of stress corrosion cracking even with that material. In addition, the strength is undesirably reduced when the Zn content is decreased to improve resistance to stress corrosion cracking, while an enhancement in the strength by addition of other elements tends to result in a reduction in workability.

The same problems are encountered also with the materials of the tubes and the copper alloy tank material. In case of tube materials, dezincification corrosion of the inner tube surface by a coolant can be avoided by addition of Sn and P to the tube material but dezincification which tends to be caused on the external side of the tube by road salt cannot be avoided unless the Zn content is reduced. Such a reduction in the Zn content may impair the strength significantly. Addition of additives or elements for the purpose of compensating for the reduction in the strength tends to cause a reduction in the workability.

SUMMARY OF THE INVENTION

Accordingly, an object of the present invention is to provide a copper alloy for use as the material of a heat exchanger which exhibits the following advantageous features: namely, high resistance to stress corrosion cracking and dezincification corrosion by virtue of reduced zinc content, high strength and workability despite the reduced zinc content, superior corrosion resistance in the presence of road salts containing chlorides, and high solder wettability which is as high as that of conventional brass material.

To this end, according to the present invention, there is provided a copper alloy for use as a material of a heat exchanger containing not less than 1 wt % but not more than 4.5 wt % of Zn, not less than 1.0 wt % but not more than 2.5 wt % of Sn, not less than 0.005 wt % but not more than 0.05 wt % of P, and the balance substantially Cu and inevitable impurities, and having a grain size not greater than 0.015 mm.

In a preferred form of the copper alloy of the invention for use as the material of a heat exchanger, the grain size of the alloy in the above-mentioned composition is below 0.01 mm.

In another preferred form of the copper alloy of the invention for use as the material of a heat exchanger, the alloy contains not less than 1 wt % but not more than 4.5 wt % of Zn, not less than 1.5 wt % but not more than 2.0 wt % of Sn, not less than 0.01 wt % but not more than 0.04 wt % of P, and the balance substantially Cu and inevitable impurities, and having a grain size not greater than 0.015 mm, preferably below 0.01 mm.

DESCRIPTION OF THE PREFERRED EMBODIMENTS

The reasons of restrictions of the alloy contents will be described hereinafter. In the following description, the contents are expressed in terms of weight percents.

Zn improves the strength of the material, as well as corrosion resistance in an atmosphere containing corrosive content such as a chloride. Presence of Zn, however, adversely affects the resistance to the stress corrosion cracking and dezincification corrosion. The improvement in the strength and resistance to atmospheric corrosion is not appreciable when the Zn content is below 1%. Conversely, a Zn content exceeding 4.5% increases a tendency for stress corrosion cracking.

Sn improves the strength, resistance to stress corrosion cracking and resistance to dezincification. These effects are not appreciable when the Sn content is below 1.0%, while an Sn content exceeding 2.5% impairs hot and cold workability. The Sn content therefore preferably ranges between 1.0 and 2.5%, more preferably between 1.5 and 2.0%.

P acts as a deoxidizer in melting and improves deep drawability. In order to enjoy such advantages, the P content should not be below 0.005%. On the other hand, P tends to promote stress corrosion cracking when added in excess of 0.05%. The P content therefore preferably ranges between 0.005 and 0.05%, more preferably between 0.01 and 0 04%.

High workability is an essential requisite for the material of the tanks, tube plates and tubes. The alloy of the invention, therefore, is preferably subjected to an annealing which is conducted for a period of 6 seconds to 6 hours at a temperature of between 400° C. and 800° C., followed, if necessary, by a slight temper rolling, before put into use. Thus, the alloy of the present invention is used, as a rule, in a state in which it exhibits a recrystallized structure. The properties of the alloy vary depending on grain size. Namely, smaller grain sizes generally improve stress corrosion cracking resistance and strength. The grain size is controllable by a suitable selection of the reduction and the annealing condition. In order to obtain a high resistance to stress corrosion resistance, grain size is preferably maintained not greater than 0.015 mm and more preferably below 0.01 mm.

Examples of the alloys of the invention are shown below.

EXAMPLE 1

Sample alloys Nos. 1 to 31 shown in Table 1 were melted in graphite crucibles under coverage by charcoal and were cast in molds so that ingots of 35 mm thick, 90 mm wide and 150 mm long were obtained. Each ingot was hot-rolled into a cake having a thickness of 12 mm, followed by a cold rolling to reduce the thickness down to 2.0 mm. Then, after 1 hour intermediate annealing at 450° C., each sample was cold rolled to reduce the thickness down to 0.8 mm (cold working ratio 60%),followed by a final annealing conducted at 430° C. for 1 hour.

Samples of comparison alloys and a conventional alloy were prepared by the same process as the sample Nos. 1 to 27, except that the final rolling was conducted at a working ratio of 47% and that the final annealing was conducted for 1 hour at 550° C. Test pieces were fabricated from these samples and yield strength and Erichsen value were measured for each test piece.

The stress corrosion cracking test was carried out in the following manner. A dessicator having an internal volume of 13l was charged with 500 cc of a commercially available 28% aqueous ammonia and 500 cc of pure water. Each test piece was prepared in the form of a strip having an overall length of 150 mm, width of 12.7 mm and a thickness of 0.8 mm and was bent in a manner specified by ASTM Designation: G 30-72, FIG. 1 (*e*) and the thus bent test piece was hung in moisture of the liquid staying in the dessicator. The resistance to stress corrosion cracking was then measured both in terms of the time elapsed until a crack is formed and the time until the test piece is ruptured. The results of the measurements are also shown in Table 1.

From Table 1, it will be understood that the samples of the alloy of the present invention exhibit remarkably improved resistance to stress corrosion cracking as compared with conventional alloy samples. In addition, the time until the generation of a crack is generally 10 times or more as high as that of the alloy sample 31 which is brass. The yield strength depends on the condition of the heat-treatment but the samples of the alloy of the invention generally exhibit higher yield strength than the conventional alloy. It will be also understood that the samples of the alloy of the invention exhibit high Erichsen values which are well compared with those of conventional alloys.

The alloy sample Nos. 1, 5, 14, 23 and 24 are subjected to a salt spray test conducted for 192 hours, together with samples of the conventional alloy. The samples of the alloy of the invention showed much higher resistance to dezincification than the conventional alloy.

TABLE 1

| | Alloy Sample Nos. | Chemical Composition (wt %) Zn | Sn | P | Cu | Grain Size (μm) | Stress Corrosion Cracking Resistance (Hr) Crack Time | Rupture Time | Yield Strength (kgf/mm²) | Erichsen Value (mm) |
|---|---|---|---|---|---|---|---|---|---|---|
| ALLOYS OF INVENTION | 1* | 2.0 | 1.0 | 0.006 | Bal. | 8 | >500 | >500 | 14.3 | 12.7 |
| | 2 | 1.9 | 1.5 | 0.005 | Bal. | 9 | >500 | >500 | 16.7 | 12.3 |
| | 3 | 2.0 | 2.0 | 0.005 | Bal. | 8 | >500 | >500 | 18.0 | 12.2 |
| | 4* | 3.3 | 1.0 | 0.005 | Bal. | 7 | >500 | >500 | 15.7 | 12.5 |
| | 5 | 3.2 | 1.5 | 0.006 | Bal. | 9 | >500 | >500 | 17.5 | 11.9 |
| | 6 | 3.0 | 2.1 | 0.004 | Bal. | 7 | >500 | >500 | 19.4 | 12.4 |
| | 7 | 4.1 | 1.1 | 0.005 | Bal. | 6 | 470 | >500 | 16.3 | 12.5 |
| | 8 | 4.0 | 1.6 | 0.005 | Bal. | 5 | >500 | >500 | 18.6 | 12.1 |
| | 9 | 4.3 | 2.0 | 0.004 | Bal. | 4 | >500 | >500 | 20.1 | 12.2 |
| | 10 | 2.0 | 1.1 | 0.020 | Bal. | 6 | >500 | >500 | 14.4 | 12.7 |

TABLE 1-continued

| | Alloy Sample Nos. | Chemical Composition (wt %) Zn | Sn | P | Cu | Grain Size (μm) | Stress Corrosion Cracking Resistance (Hr) Crack Time | Rupture Time | Yield Strength (kgf/mm²) | Erichsen Value (mm) |
|---|---|---|---|---|---|---|---|---|---|---|
| | 11 | 1.8 | 1.6 | 0.023 | Bal. | 7 | >500 | >500 | 17.5 | 12.6 |
| | 12 | 2.0 | 2.0 | 0.014 | Bal. | 6 | >500 | >500 | 17.5 | 12.4 |
| | 13* | 3.2 | 1.0 | 0.018 | Bal. | 7 | 144 | 240 | 15.3 | 12.8 |
| | 14 | 3.1 | 1.6 | 0.016 | Bal. | 6 | >500 | >500 | 16.8 | 12.1 |
| | 15 | 3.1 | 2.1 | 0.010 | Bal. | 7 | >500 | >500 | 17.7 | 12.4 |
| | 16* | 4.1 | 1.0 | 0.014 | Bal. | 7 | 192 | 320 | 16.1 | 12.5 |
| | 17 | 4.3 | 1.6 | 0.017 | Bal. | 4 | >500 | >500 | 18.4 | 12.4 |
| | 18 | 4.1 | 2.1 | 0.017 | Bal. | 4 | >500 | >500 | 20.0 | 11.9 |
| | 19 | 2.0 | 1.1 | 0.047 | Bal. | 6 | >500 | >500 | 14.8 | 13.2 |
| | 20 | 1.9 | 1.4 | 0.028 | Bal. | 7 | >500 | >500 | 16.7 | 13.1 |
| | 21 | 2.0 | 2.1 | 0.035 | Bal. | 6 | >500 | >500 | 18.6 | 12.7 |
| | 22 | 3.1 | 1.1 | 0.038 | Bal. | 7 | >500 | >500 | 14.7 | 13.1 |
| | 23 | 3.2 | 1.6 | 0.040 | Bal. | 5 | >500 | >500 | 17.1 | 13.0 |
| | 24 | 3.0 | 2.1 | 0.041 | Bal. | 4 | >500 | >500 | 18.4 | 13.1 |
| | 25 | 3.9 | 1.1 | 0.035 | Bal. | 7 | 120 | 200 | 15.4 | 12.9 |
| | 26 | 3.9 | 1.6 | 0.033 | Bal. | 6 | 320 | 370 | 17.6 | 12.4 |
| | 27 | 4.0 | 2.2 | 0.047 | Bal. | 3 | 496 | >500 | 21.2 | 12.3 |
| * | 28 | 7.0 | 1.0 | 0.12 | Bal. | 35 | 24 | 24 | 13.2 | 14.3 |
| | 29 | 8.7 | 2.3 | 0.19 | Bal. | 35 | 21 | 142 | 14.6 | 13.8 |
| | 30 | — | — | 0.025 | Bal. | 35 | 120 | >500 | 9.1 | 11.8 |
| ** | 31 | 35 | — | — | Bal. | 45 | 3 | 3 | 13.1 | 13.9 |

*Comparison Alloys
**Conventional Alloy

EXAMPLE 2

An alloy containing 2.9% of Zn, 1.5% of Sn, 0.014% of P and the balance substantially Cu was processed in the same manner as Example 1 and nine samples of this alloy were prepared by adopting three different final reductions of 66%, 47% and 33% and three final annealing temperatures of 550° C., 480° C. and 410° C. Grain sizes were measured with these samples, in addition to the properties evaluated in Example 1, the results being shown in Table 2.

From Table 2, it will be understood that the resistance to stress corrosion cracking, as well as yield strength, is improved as grains become finer. Samples 7,8 and 9 had large grain size due to high final annealing temperature and, hence, exhibited inferior yield strength as compared with the conventional alloy. These samples also showed rather high sensitivity to stress corrosion cracking.

TABLE 2

| | Alloy Sample Nos. | Chemical Composition (wt) Zn | Sn | P | Cu | Final Reduction (%) | Anneal Temp. (°C.) | Grain Size (μm) | Stress Corrosion Cracking Resistance (Hr) Crack Time | Rupture Time | Yield Strength (kgf/mm²) | Erichsen Value |
|---|---|---|---|---|---|---|---|---|---|---|---|---|
| ALLOYS OF INVENTION | 1 | 2.9 | 1.5 | 0.014 | Bal. | 67 | 480 | 0.010 | 192 | >336 | 14.3 | 13.9 |
| | 2 | 2.9 | 1.5 | 0.014 | Bal. | 67 | 410 | 0.005 | >336 | >336 | 18.6 | 13.2 |
| | 3 | 2.9 | 1.5 | 0.014 | Bal. | 47 | 480 | 0.010 | 336 | >336 | 13.8 | 13.5 |
| | 4 | 2.9 | 1.5 | 0.014 | Bal. | 47 | 410 | 0.005 — 0.010 | >336 | >336 | 16.3 | 13.3 |
| | 5 | 2.9 | 1.5 | 0.014 | Bal. | 33 | 480 | 0.005 — 0.010 | >336 | >336 | 13.6 | 14.1 |
| | 6 | 2.9 | 1.5 | 0.014 | Bal. | 33 | 410 | 0.010 | >336 | >336 | 15.2 | 13.4 |
| * | 7 | 2.9 | 1.5 | 0.014 | Bal. | 67 | 550 | 0.035 | 192 | 288 | 11.8 | 14.0 |
| | 8 | 2.9 | 1.5 | 0.014 | Bal. | 47 | 550 | 0.035 | 120 | 288 | 11.7 | 14.3 |
| | 9 | 2.9 | 1.5 | 0.014 | Bal. | 33 | 550 | 0.035 | 240 | >336 | 11.5 | 14.0 |
| ** | 10 | 35 | — | — | Bal. | — | — | 0.045 | 3 | 3 | 13.1 | 13.9 |

*Comparison Alloys
**Conventional Alloy

A solder wettability test was conducted on all the samples shown in Tables 1 and 2, using weak-active rosin. All the samples showed generally acceptable levels of solder wettability.

As will be realized from the foregoing description, the present invention provides a copper alloy which exhibits much superior corrosion resistance such as stress corrosion cracking resistance as compared with conventional material, as well as high strength and high workability which well compared with those of the conventional material.

What is claimed is:

1. A copper alloy for use as a material of a heat exchanger consisting essentially of not less than 1 wt % but not more than 4.5 wt % of Zn, from about 1.1 wt % to 2.5 wt % of Sn, not less than 0.005 wt % but not more than 0.05 wt % of P, and the balance substantially Cu and inevitable impurities, and having a grain size not greater than 0.015 mm.

2. A copper alloy according to claim 1, wherein said grain size is below 0.01 mm.

3. A copper alloy for use as a material of a heat exchanger consisting essentially of not less than 1 wt % but not more than 4.5 wt % of Zn, not less than 1.5 wt % but not more than 2.0 wt % of Sn, not less than 0.01 wt % but not more than 0.04 wt % of P, and the balance substantially Cu and inevitable impurities, and having a grain size not greater than 0.015 mm.

4. A copper alloy according to claim 3, wherein said grain size is below 0.01 mm.

* * * * *